United States Patent [19]

Neumann

[11] 4,426,851

[45] Jan. 24, 1984

[54] ICE MAKER DIAGNOSTIC SYSTEM

[75] Inventor: Charles G. Neumann, Palatine, Ill.

[73] Assignee: Reynolds Products Inc., Schaumburg, Ill.

[21] Appl. No.: 411,645

[22] Filed: Aug. 26, 1982

[51] Int. Cl.[3] ..... F25B 49/00

[52] U.S. Cl. ..... 62/126; 62/127; 62/354; 340/514; 340/521; 340/585; 340/617; 340/618

[58] Field of Search ..... 62/126, 127, 354; 165/11 R; 236/94; 340/514, 517, 521, 585, 612, 617, 618

[56] References Cited

U.S. PATENT DOCUMENTS

| | | | |
|---|---|---|---|
| 2,766,439 | 10/1956 | Palm | 62/127 X |
| 2,994,858 | 8/1961 | Coffer | 340/585 |
| 3,100,383 | 8/1963 | Foster et al. | 62/126 |
| 3,311,906 | 3/1967 | Coffer et al. | 62/126 X |
| 3,736,765 | 6/1973 | O'Dell | 62/127 |
| 3,886,517 | 5/1975 | Ohtake et al. | 340/618 X |
| 3,893,108 | 7/1975 | McBride, Jr. et al. | 340/618 X |
| 3,970,929 | 7/1976 | Borucki et al. | 340/514 X |
| 4,195,500 | 4/1980 | Tobita et al. | 340/517 X |
| 4,234,866 | 11/1980 | Kuroda et al. | 340/521 X |
| 4,295,129 | 10/1981 | Cade | 236/94 X |

*Primary Examiner*—William E. Tapolcai
*Attorney, Agent, or Firm*—Shenier & O'Connor

[57] ABSTRACT

A diagnostic system for identifying certain disabling abnormal conditions in an ice maker. The system includes a display panel having a pair of indicator lights and a push button switch, which when used together with a legend enables the operator to determine which particular abnormal condition needs correction.

8 Claims, 3 Drawing Figures

ICE MAKER DIAGNOSTIC SYSTEM

FIELD OF THE INVENTION

My invention relates to the field of diagnostic systems and more particularly to a diagnostic system for an auger type ice maker.

BACKGROUND OF THE INVENTION

In general, auger type ice makers include a water tank in which water to be frozen is stored, an evaporator assembly having a cylindrical surface on which ice crystals are formed, and a driven auger which removes the ice from the evaporator surface and advances it through an extruding head to form ice pieces which move into a storage bin. In addition, various safety features are employed to shut off the ice maker in the event of the occurrence of several abnormal conditions. For example, if the storage bin is full, if the water tank is empty, or if the motor driving the auger overheats, the ice maker is adapted to turn itself off.

These abnormal conditions occur relatively frequently and yet are readily remedied. However, as the operator does not know which condition has disabled the ice maker, a call to the service person is often required, together with the resulting "down" time.

SUMMARY OF THE INVENTION

One object of my invention is to provide a diagnostic system for an ice maker which enables the operator to identify a number of relatively frequently occurring and readily remedied faults so as to reduce calls to the service person and the resultant "down" time of the ice maker.

Another object of my invention is to provide a diagnostic system for an ice maker which is simple in operation and inexpensive in construction.

Still another object of my invention is to provide a diagnostic system for an ice maker which provides a quickly and easily understood visible indication of the fault.

Other and further objects will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
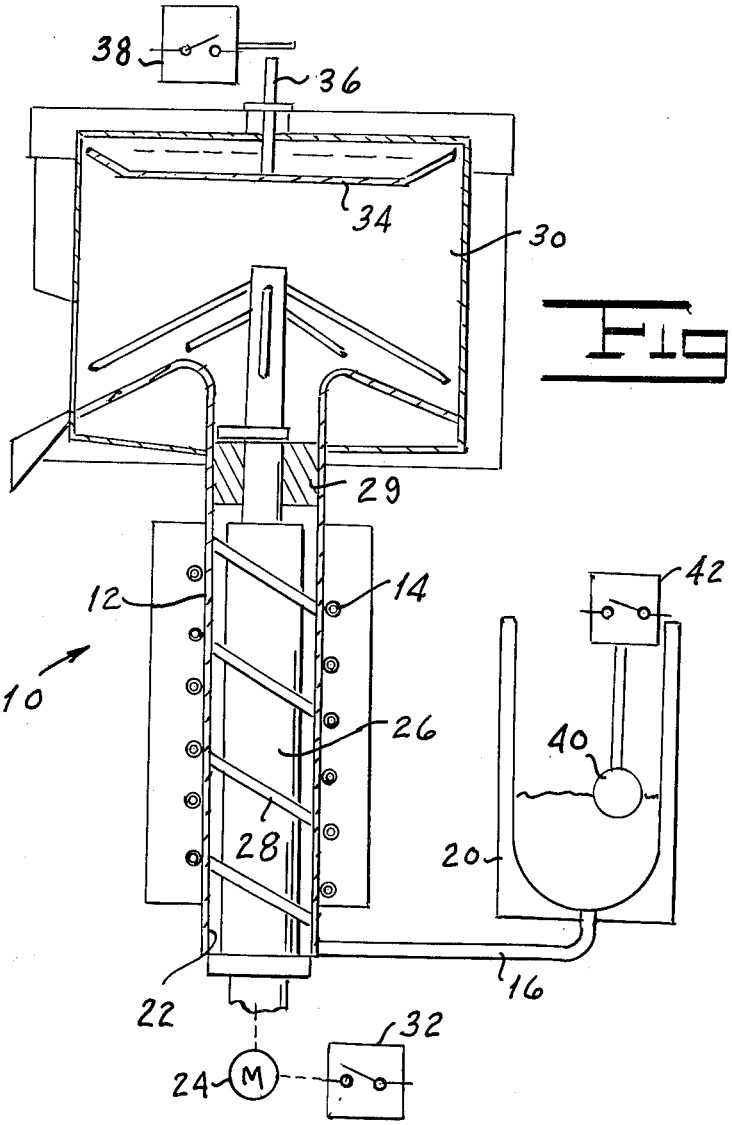
FIG. 1 is a fragmentary sectional view of an improved auger type ice maker with which my diagnostic system may be used, with parts broken away and with other parts shown schematically.

Referring now to FIG. 1, an auger type ice maker 10, with which my diagnostic system may be used, includes an evaporator housing 12 surrounded by a coil 14 through which refrigerant is passed in a manner known to the art to chill the housing 12. A pipe 16 leading from a water tank 20 supplies water to the inner freezing surface 22 of the housing 12.

A motor 24 is adapted to be energized in a manner known to the art to rotate an auger 26 having a helical blade 28, in the direction indicated by the arrow in FIG. 1. This causes blade 28 to scrape ice crystals off the surface 22 and to advance these crystals upwardly to an extruding head 29 in which pieces of ice are formed and then fed to a bin 30. As a safety feature motor 24 is adapted to open normally closed switch 32 in the event of thermal overload, cutting off the ice maker.

As the bin 30 is filled with ice, a plate 34 is moved from its normal position to the position indicated by the dotted lines, causing plunger 36 to open normally closed switch 38, shutting off the ice maker.

Water is supplied to the tank 20 from the main supply line (not shown) which is adapted to maintain a certain water level within the tank. Should the supply of water be cut off, the ice maker will continue operating until the water in the tank 20 falls below a certain safety level, at which point float 40 will open normally closed switch 42, turning off the ice maker.

Figure 2:
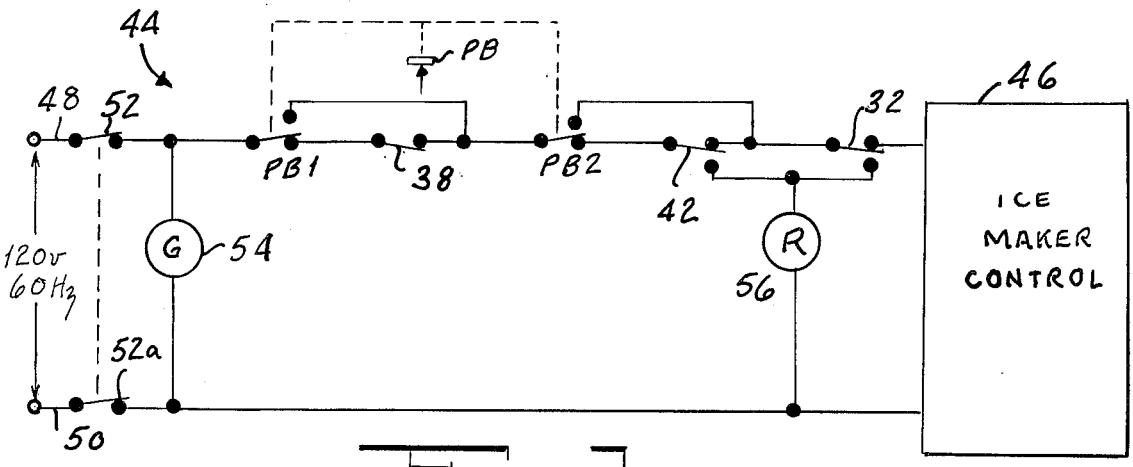
FIG. 2 is a schematic view of my diagnostic system for an ice maker.
Figure 3:
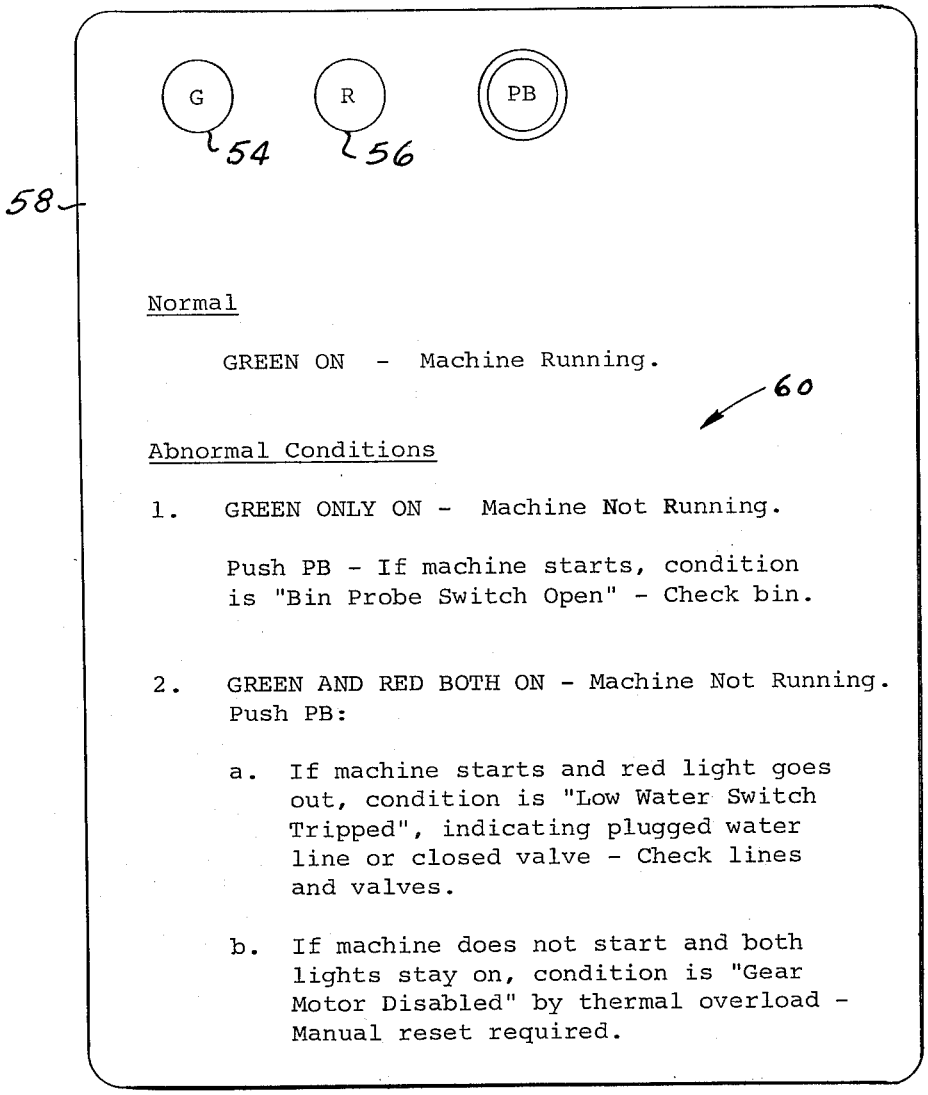
FIG. 3 is a front elevation of the indicator panel of my diagnostic system.

Referring now to FIGS. 2 and 3, my diagnostic system includes a circuit 44 which is adapted to be connected across the power input terminals of the ice maker control circuit 46. My circuit includes a source of voltage such for example as a 120 volt 60 HZ source feeding lines 48 and 50.

Ganged switches 52 and 52*a* are closed to connect the power source to the system, illuminating the green lamp 54 as an indication of such, and power is further supplied to the ice maker control circuit 46 through switch PB1, bin probe switch 38, switch PB2, low water safety switch 42 and gear motor overload switch 32, all shown in their normal positions. Thus, in normal operation, the green lamp 54 is illuminated and the machine 10 is on.

The green lamp 54 together with a red lamp 56 and a pushbutton switch PB, the function of both to be more fully described hereinbelow, are mounted on a panel 58 which should be situated on the ice maker 10 so as to be clearly visible and accessible to the operator.

It will be seen that the ice maker is adapted to turn itself off in the event of the occurrence of any of three abnormal conditions. If, in the first instance, the ice bin 30 is full, bin probe switch 38 will open, disconnecting the power source from the control circuit 46, to turn the ice maker off while leaving the green lamp 54 illuminated. In this situation, with the green lamp 54 on and the machine not running, the operator is instructed to press the push button switch PB on the control panle 58. This causes switches PB1 and PB2 to engage their normally open upper contacts, bypassing the open bin probe switch 38 to connect the power source to the control circuit 46. The ice maker will run as long as the operator presses the push button PB. The fact that the ice maker will start indicates that the ice bin 30 is full.

The second abnormal condition is caused by the failure of the main water line to fill the tank 20, allowing the water level to drop to a low level. This causes the low water safety switch 42 to engage its normally open lower contact, thus disconnecting the power source from the control circuit 46 and illuminating the red lamp 56. In this situation, both green and red lamps are illuminated and the machine is not running. The operator is again instructed to press the push button PB, causing switches PB1 and PB2 to engage their normally open contacts. This operation bypasses the low water switch 42 to turn off the red lamp 56 and supplies power to the control circuit 46. The red light remains off and the ice maker runs for so long as the push button PB is held. The two results, that the red light goes off and that the ice maker runs when PB is actuated after both lights have gone on, indicate either a plugged water line or a closed valve. The lines and valves should be checked to remedy the defect.

The third abnormal condition is a thermal overload of the motor 24 which causes the gear motor overload switch 32 to engage its normally open lower contact to turn the ice maker off and to illuminate the red lamp. In this situation the user is again instructed to actuate PB. When he does, however, the machine will not start and the red lamp will not go out since the gear motor safety switch 32 is not bypassed. This indicates that the gear motor has been disabled by a thermal overload.

It should be noted that if more than one abnormal condition exists at one time, my diagnostic system will prevent normal operation of the ice maker until all have been corrected. If, for example, both the bin probe switch 38 and the low water switch 42 are open, the green lamp 54 will be illuminated and the ice maker will be off. Upon pressing the push button PB the machine will start, properly indicating an open bin probe switch 38. Once this situation is corrected the machine will still be off and now the red lamp 56 will be illuminated. The operator will once again press the push button PB, the red lamp will go out and the machine will start, properly indicating an open low water switch 42.

If the bin probe switch 38 and the gear motor overload switch 32 are both open, the green lamp will be illuminated and the ice maker will be off. When the operator presses the push button, the red light will also be illuminated However, the machine will not start, properly indicating that the gear motor overload switch 32 is open. After switch 32 is reset, the machine still will not start and the green light will be on. The operator will once again press the push button and the machine will start, properly indicating an open bin probe switch 38.

If the low water switch 42 and the gear motor overload switch 32 are both open, both the green and red lamps will be illuminated and the machine will not be running. When the operator presses the push button the machine will not start and the red light will not go out, properly indicating that the gear motor overload switch is open. After switch 32 is reset, the machine will remain off but the red lamp will still be illuminated. Again, the operator will press the push button, the machine will start and the red lamp will go out, properly indicating that the low water switch 42 is open.

In addition, if all three safety switches 38, 42, and 32 are open, the green lamp will be illuminated and the machine will be off. Upon pressing the push button, the red lamp will also be illuminated but the machine will not start, indicating that the gear motor overload switch 32 is open. After the switch is reset, both green and red lamps will be illuminated and the machine will be off. Pressing the push button will start the machine and turn off the red lamp, properly indicating an open low water switch 42. After this condition is corrected, only the green lamp will be on and the machine will still be off. Pressing the push button will start the machine, indicating an open bin probe switch 38.

To aid the operator in trouble shooting, I place a legend 60 on the panel 58.

It will be seen that I have accomplished the objects of my invention. I have provided a diagnostic system for an ice maker which enables the operator to identify a number of relatively frequently occurring and readily remedied faults so as to reduce calls to the service person and the resultant "down" time of the ice maker. My diagnostic system is simple in operation and inexpensive in construction. In addition, my diagnostic system may be quickly and easily understood.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a diagnostic system for an ice maker having respective means for disabling the ice maker in response to two different conditions, an indicator light, means responsive to each of said conditions for energizing said light, an operator-accessible manually actuatable element and means responsive to actuation of said element for energizing said deenergized ice maker in the presence of only one of said conditions to indicate which of said conditions exists.

2. In a diagnostic system for an ice maker having respective means for disabling the ice maker in response to two different conditions, an indicator light, means responsive to each of said conditions for energizing said light, an operator accessible manually actuatable element, and means responsive to actuation of said element for deenergizing said light in the presence of only one of said conditions to indicate which of said conditions exists.

3. In a diagnostic system for an ice maker having respective means for disabling the ice maker in response to two different conditions, an indicator light, means responsive to each of said conditions for energizing said light, an operator-accessible manually actuatable element, and means responsive to actuation of said element for concomitantly deenergizing said lamp and enabling said ice maker in the presence of only one of said conditions to identify said one condition, the arrangement being such that upon the actuation of said element in the presence of the other condition said lamp remains illuminated and said ice maker remains disabled.

4. A diagnostic system for an ice maker which normally runs in response to power applied thereto upon closure of an on-off switch and which stops upon the occurrence of any one of a number of abnormal conditions with said on-off switch closed including a power-on light adapted to be illuminated upon the application of power to said ice maker by said on-off switch, first abnormal condition responsive means for disabling said ice maker with said on-off switch closed, an indicator light, a second abnormal condition responsive means for disabling said ice maker and illuminating said indicator light with said on-off switch closed, third abnormal condition responsive means for disabling said ice maker and illuminating said indicator light, an operator-accessible manually actuatable element, first means responsive to actuation of said element for bypassing said first abnormal condition responsive means to enable said ice maker to indicate the presence of said first abnormal condition, and second means responsive to actuation of said element for bypassing said second abnormal condition responsive means to enable said ice maker to indicate the presence of said second abnormal condition.

5. A circuit for applying power to an ice maker from a source including in combination, a power-on light, an on-off switch adapted to be closed to apply power to said light, a plurality of condition responsive switches each having a first state and a second state in response to an abnormal condition, means connecting said condition responsive switches in series between said on-off switch and said ice maker to apply power thereto in the absence of an abnormal condition and with said on-off switch closed, an indicator light, means connecting said indicator light to said condition responsive switches to be illuminated in response to movement of one of said switches to its second state, an operator-accessible manually-actuatable element, a first switch responsive to actuation of said element for bypassing a first one of said condition responsive switches to energize said ice maker with said first condition responsive switch in its second state to indicate the existence of a first abnormal condition, and a second switch responsive to actuation of said element for bypassing a second one of said condition responsive switches to energize said ice maker with said second condition responsive switch in its second state to indicate the existence of a second abnormal condition.

6. A diagnostic system for identifying certain abnormal conditions in an ice maker comprising means for disconnecting the power source from the ice maker in response to certain abnormal conditions, indication means responsive to said abnormal conditions, means for temporarily bypassing said disconnecting means to connect the power source to the ice maker as a further indication of a particular abnormal condition.

7. A diagnostic system for identifying certain disabling abnormal conditions in an ice maker comprising indicator lights, means for illuminating said lights in a prescribed manner in response to certain abnormal conditions and means for reenabling said disabled ice maker under said abnormal conditions as a further indication of a particular abnormal condition.

8. In an ice maker having an evaporator housing with an inner wall providing a freezing surface on which ice crystals may form, an auger in said housing adapted to be driven to harvest ice crystals from said freezing surface, motor means for driving said auger, means for deenergizing said motor means in response to certain abnormal conditions, visual indication means responsive to said abnormal conditions and means for energizing said deenergized motor means as a further indication of a particular abnormal condition.

* * * * *